US009144527B2

(12) United States Patent
Reinke

(10) Patent No.: US 9,144,527 B2
(45) Date of Patent: Sep. 29, 2015

(54) STRETCHER SEAT SECTION ARTICULATION MECHANISMS AND METHODS

(71) Applicant: Hill-Rom Services, Inc., Batesville, IN (US)

(72) Inventor: Christian H. Reinke, York, SC (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 13/920,330

(22) Filed: Jun. 18, 2013

(65) Prior Publication Data

US 2013/0333115 A1 Dec. 19, 2013

Related U.S. Application Data

(60) Provisional application No. 61/660,851, filed on Jun. 18, 2012, provisional application No. 61/661,000, filed on Jun. 18, 2012.

(51) Int. Cl.

| | |
|---|---|
| ***A61G 7/015*** | (2006.01) |
| ***A61G 7/018*** | (2006.01) |
| ***A61G 7/002*** | (2006.01) |
| *A61G 7/05* | (2006.01) |
| *A47C 20/04* | (2006.01) |

(52) U.S. Cl.

CPC ..... *A61G 7/015* (2013.01); *A61G 7/002* (2013.01); *A61G 7/018* (2013.01); *A47C 20/04* (2013.01); *A61G 2007/0514* (2013.01)

(58) Field of Classification Search

CPC ..... A61G 7/015; A61G 7/018; A61G 7/022; A61G 2007/0514; A47C 20/04

USPC ..... 5/613, 617, 618, 616

See application file for complete search history.

(56) References Cited

U.S. PATENT DOCUMENTS

| | | | | |
|---|---|---|---|---|
| 5,790,997 | A | 8/1998 | Ruehl | |
| 6,247,753 | B1 * | 6/2001 | Alvestad | 297/362.13 |
| 6,907,631 | B2 * | 6/2005 | Heaton | 5/618 |
| 7,124,456 | B2 | 10/2006 | Palmatier et al. | |
| 7,395,564 | B2 | 7/2008 | McDaniel et al. | |
| 8,069,513 | B2 | 12/2011 | Turner et al. | |

FOREIGN PATENT DOCUMENTS

| | | | |
|---|---|---|---|
| GB | 2345439 A | * | 7/2000 |

* cited by examiner

*Primary Examiner* — Peter M Cuomo
*Assistant Examiner* — Brittany Wilson
(74) *Attorney, Agent, or Firm* — Kenneth C. Baran

(57) ABSTRACT

Articulation systems and methods of use for a person support apparatus are disclosed. A head support section of a person support apparatus is configured to translate as its inclination with respect to a horizontal surface varies. The inclination of a seat support section is configured to vary as the inclination of the head support section changes with respect to a horizontal surface. Weight acting the seat support section assists in variation of inclination of the head support section.

17 Claims, 9 Drawing Sheets

STRETCHER SEAT SECTION ARTICULATION MECHANISMS AND METHODS

BACKGROUND

The present disclosure relates to articulation mechanisms of a hospital stretcher and other person support apparatus. Providing the ability to raise the head support section of a hospital stretcher while requiring minimal effort by the caregiver is an ongoing challenge. While several articulation systems have been developed for hospital stretchers, a need exists for continued development in this area.

BRIEF SUMMARY

The present disclosure includes one or more of the features recited in the appended claims and/or the following features which, alone or in any combination, may comprise patentable subject matter.

One embodiment of an articulation system for use on a person support apparatus may comprise a frame member configured to support at least two deck sections. A first deck section may be configured to support a portion of a person thereon, the first deck section may be configured to translate and pivot with respect to the frame member to vary angular inclination of said first deck section with respect to said frame member. A second deck section may be configured to support a portion of a person thereon, the second deck section may be configured to change its angular orientation with respect to the frame member as the first deck section moves with respect to the frame member, where weight acting on the second deck section may serve to assist in motion of said first deck section to increase the angular inclination of the first deck section with respect to the frame member.

One embodiment of a seat articulation system may comprise a person support apparatus comprising an upper frame with a channel. A sliding block may be configured to translate in the channel, the sliding block comprises a roller support track. An upper body deck section may be supported by the upper frame, the upper body deck section may be configured to pivotably connect to the sliding block. A roller may be configured to be supported by the roller support track. A seat support section may be configured to be supported by the upper frame, a first end of the seat support section may be coupled to the roller by a pinned connection wherein translation of the sliding block in the channel may be configured to cause the roller to follow profile of the roller support track in a vertical direction with respect to the person support apparatus thereby causing motion of the first end of the seat support section in a vertical direction with respect to said person support apparatus.

Another embodiment of an articulation system for use on a person support apparatus may comprise a frame configured to support at least two deck sections. A first deck section may be configured to support a portion of a person thereon comprising means to move the first deck to vary angular inclination of the first deck section with respect to the frame member. A second deck section may be configured to support a portion of a person thereon comprising means to change angular orientation of the second deck section with respect to the frame member as the angular inclination of the first deck section with respect to the frame member varies. Weight acting on the second deck section serves to assist motion of the first deck section to increase the angular inclination of the first deck section with respect to the frame member.

One method for articulating portions of a person support apparatus comprises varying inclination of a head support section of a person support apparatus with respect to an upper frame of the person support apparatus. Varying inclination of a seat support section with respect to the upper frame as the inclination of the head support section varies wherein weight acting on the seat support section assists in varying inclination of said head support section.

BRIEF DESCRIPTION OF DRAWINGS

The accompanying drawings incorporated in and forming a part of the specification illustrate several aspects of the claimed subject matter and, together with the description, serve to explain the principles of the claimed subject matter. In the drawings:

DETAILED DESCRIPTION OF ILLUSTRATIVE EMBODIMENTS

Figure 1:
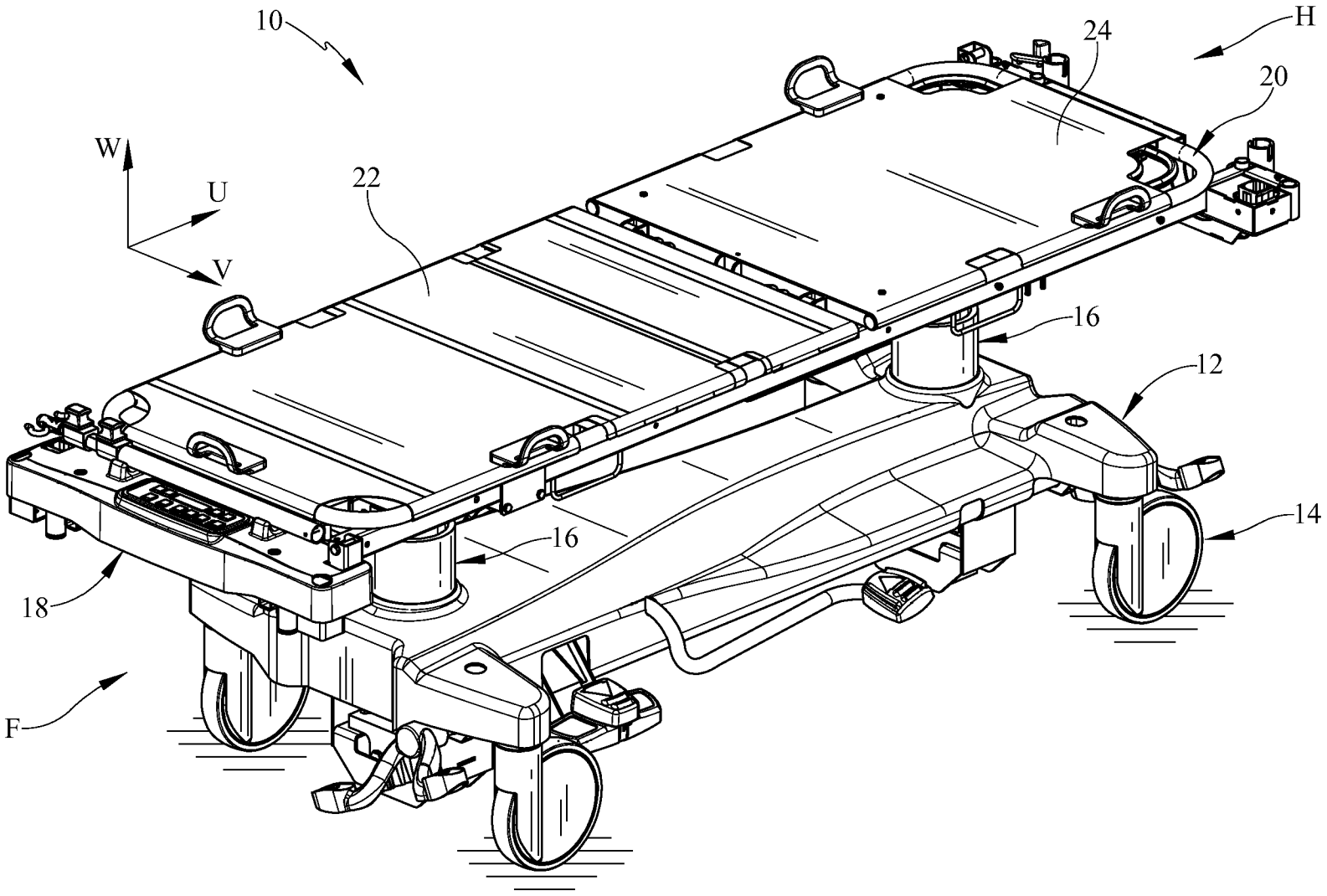
FIG. 1 is a perspective view of a stretcher, constructed according to one or more of the principles disclosed herein.

The embodiments of the claimed subject matter and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be briefly mentioned or omitted so as to not unnecessarily obscure the embodiments of the claimed subject matter described. The examples used herein are intended merely to facilitate an understanding of ways in which the claimed subject matter may be practiced and to further enable those of skill in the art to practice the embodiments of the claimed subject matter described herein. Accordingly, the examples and embodiments herein are merely illustrative and should not be construed as limiting the scope of the claimed subject matter, which is defined solely by the appended claims and applicable law. Moreover, it is noted that like reference numerals represent similar parts throughout the several views of the drawings.

It is understood that the subject matter claimed is not limited to the particular methodology, protocols, devices, apparatus, materials, applications, etc., described herein, as these may vary. It is also to be understood that the terminology used herein is used for the purpose of describing particular embodiments only, and is not intended to limit the scope of the claimed subject matter.

Unless defined otherwise, all technical and scientific terms used herein have the same meanings as commonly understood by one of ordinary skill in the art.

According to this disclosure a person support apparatus/stretcher 10 allows dropping of a seat support section with respect to the upper frame when the head support section is elevated with respect to the upper frame. The dropping of the seat support section with respect to the upper frame facilitates elevating the head support section with respect to the upper frame.

Figure 4:
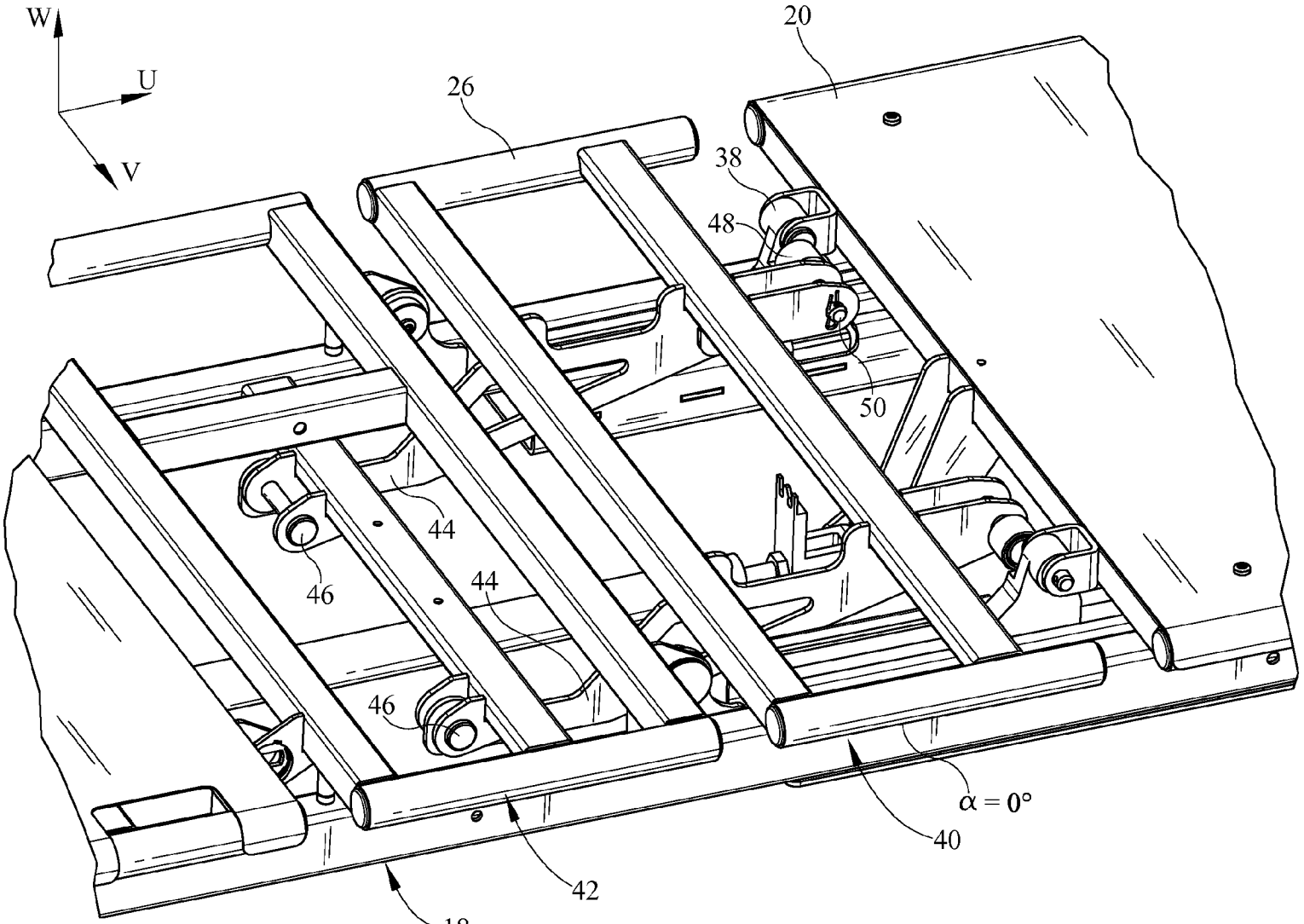
FIG. 4 is a perspective view of a stretcher showing the head, seat, thigh and a portion of the foot deck sections, constructed according to one or more of the principles disclosed herein.

FIG. 1 shows one embodiment of a person support apparatus 10. In this embodiment the person support apparatus 10 is a stretcher, in other embodiments the person support apparatus 10 is a hospital bed or any other type of hospital furniture. The stretcher extends longitudinally from a head end H to a foot end F. The stretcher 10 comprises a lower frame 12 supported by wheels 14. An upper frame 18 is configured to be variably elevated with respect to the lower frame 12 by supports 16. The upper frame 18 is configured to support an upper body deck section 20 and a lower body deck section 22. The upper body deck section 20 comprises an upper body deck panel 24 which is removably attached to the upper body deck section 20. The upper body deck section also includes a sliding block 34. The upper body deck section 20 and the sliding block 34 are pivotably connected to each other at a sliding block-upper frame deck section pivot 38. As shown in FIG. 4 the lower body deck section 22 comprises a seat deck section 26, thigh deck section 40 and a foot deck section 42 in this embodiment. In other embodiments any portions of the lower body deck section 22 may comprise removable deck panels mounted thereon. The stretcher 10 is configured to support a person thereon in a manner that the upper body of the person is supported by the upper body deck section 20, the seat deck section 26 supports the hip or buttocks region of the person. The thigh deck section 40 supports the thighs of the person. The foot deck section 42 supports the calves and feet of the person. A three dimensional co-ordinate system is shown in FIG. 1 wherein axis U aligns with the length or longitudinal dimension of the stretcher 10, axis V aligns with the width or lateral dimension of the stretcher 10 while axis W represents an axis orthogonal to U & V axes.

Figure 2:
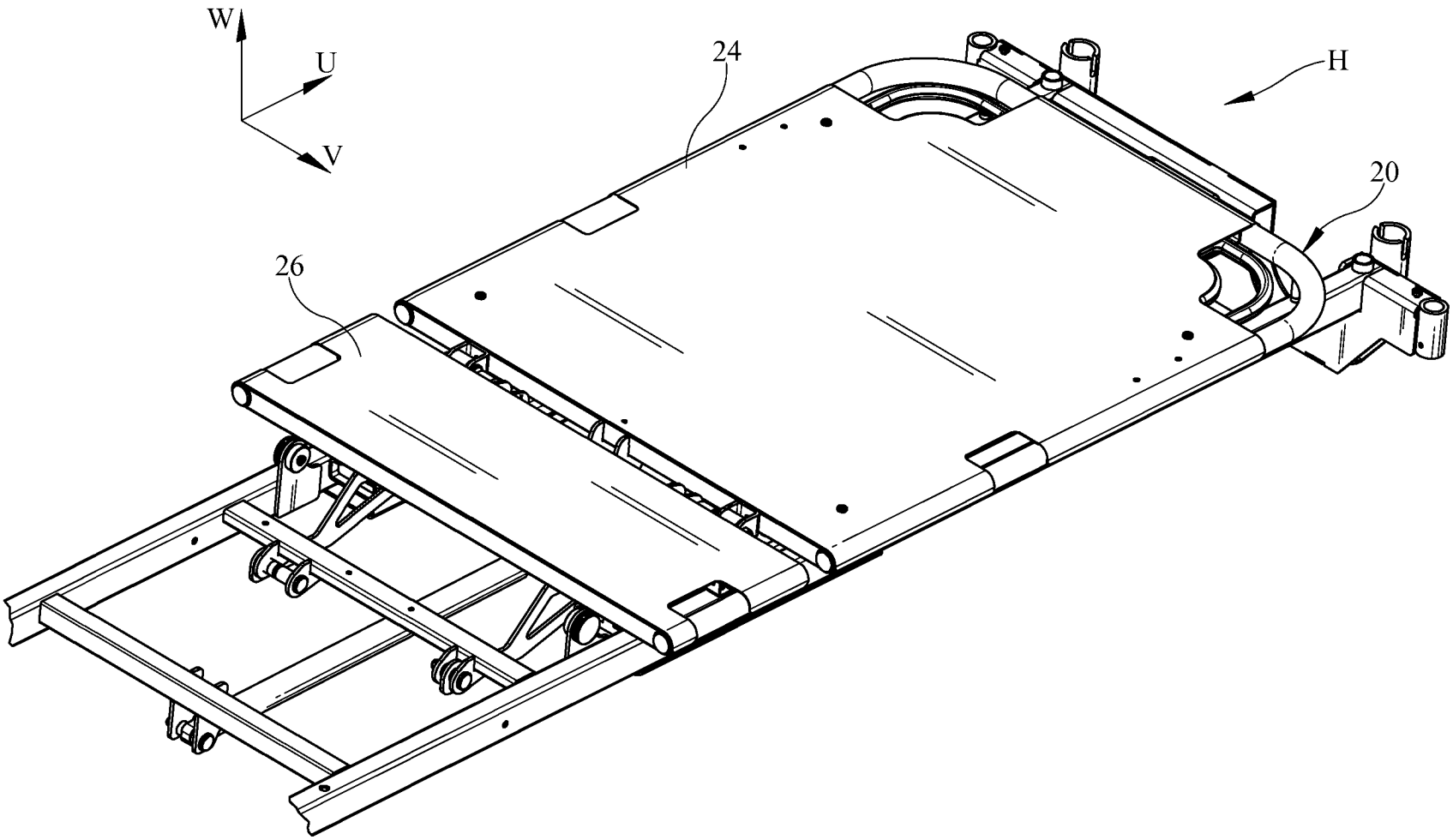
FIG. 2 is a perspective view of the upper body and seat support sections of a stretcher, constructed according to one or more of the principles disclosed herein.

FIG. 2 shows the upper body deck section 20 with an upper body deck panel 24 thereon, resting in a plane with a 0 degree inclination with the upper frame and therefore in a plane parallel to the U-V plane.

Figure 3:
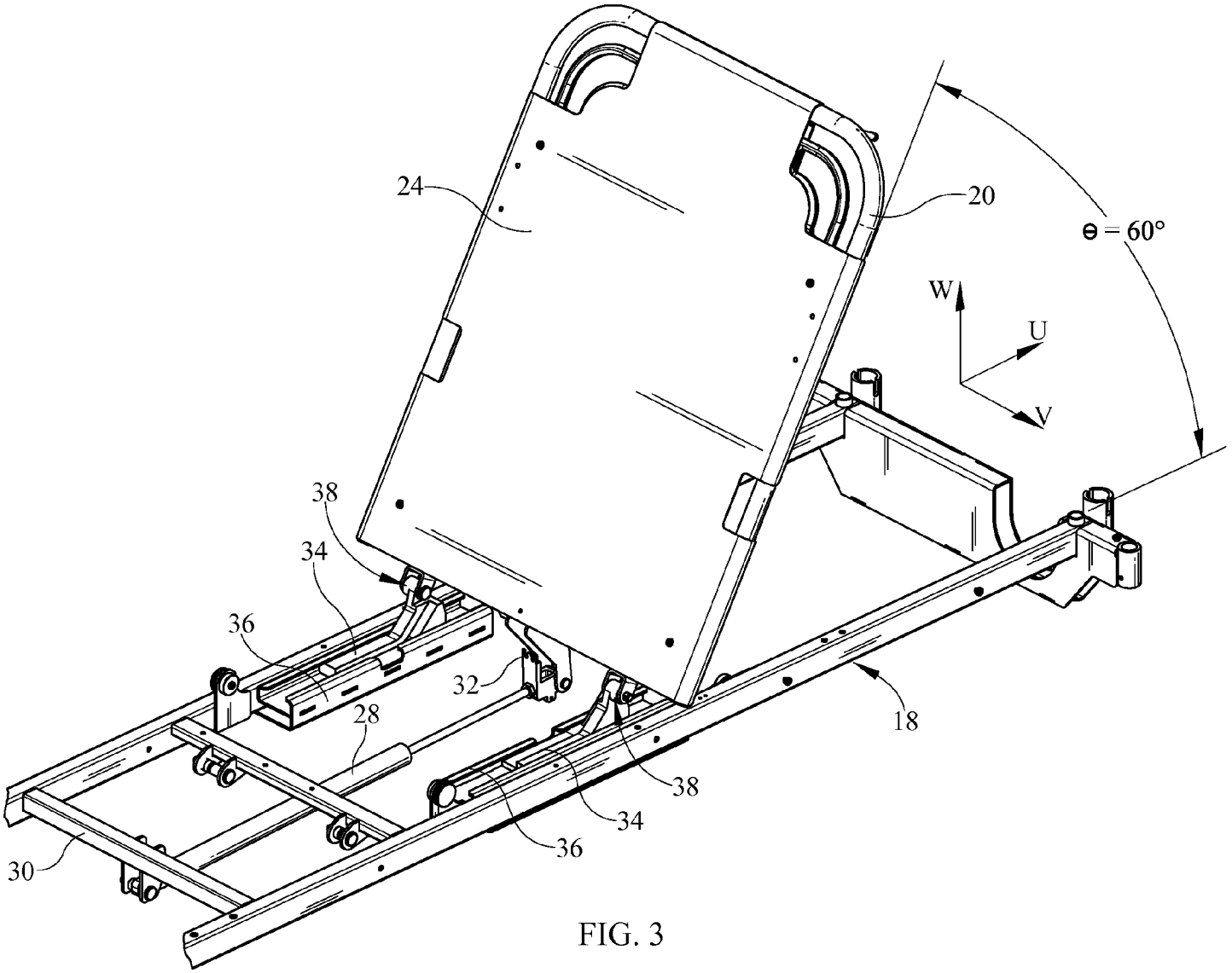
FIG. 3 is a perspective view of an articulation system for use on a person support apparatus wherein the head support deck section is at a sixty degree angle with respect to the upper frame, constructed according to one or more of the principles disclosed herein.
Figure 5:
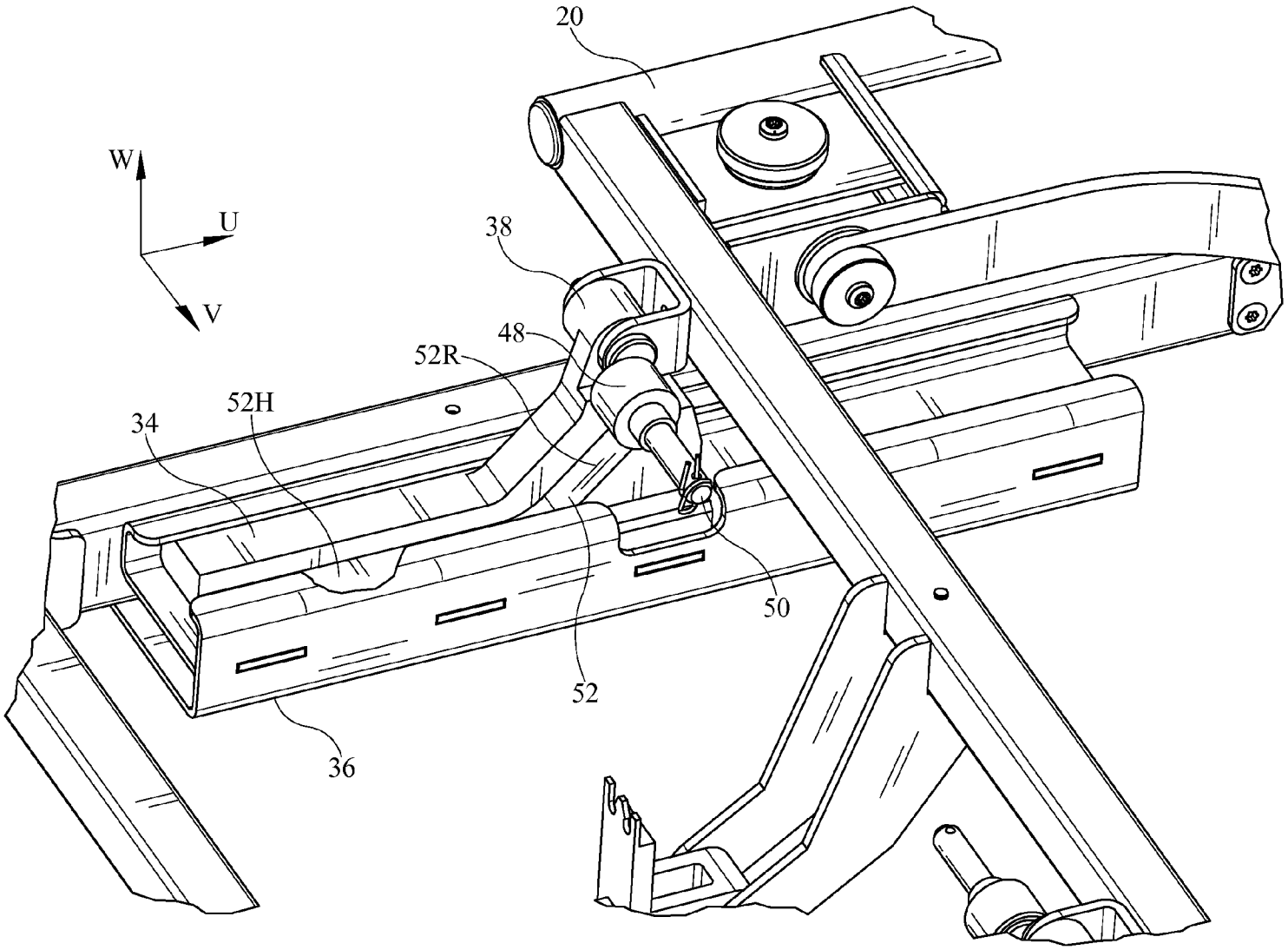
FIG. 5 is a perspective view of the sliding block and channel for use on a person support apparatus, constructed according to one or more of the principles disclosed herein.
Figure 6:
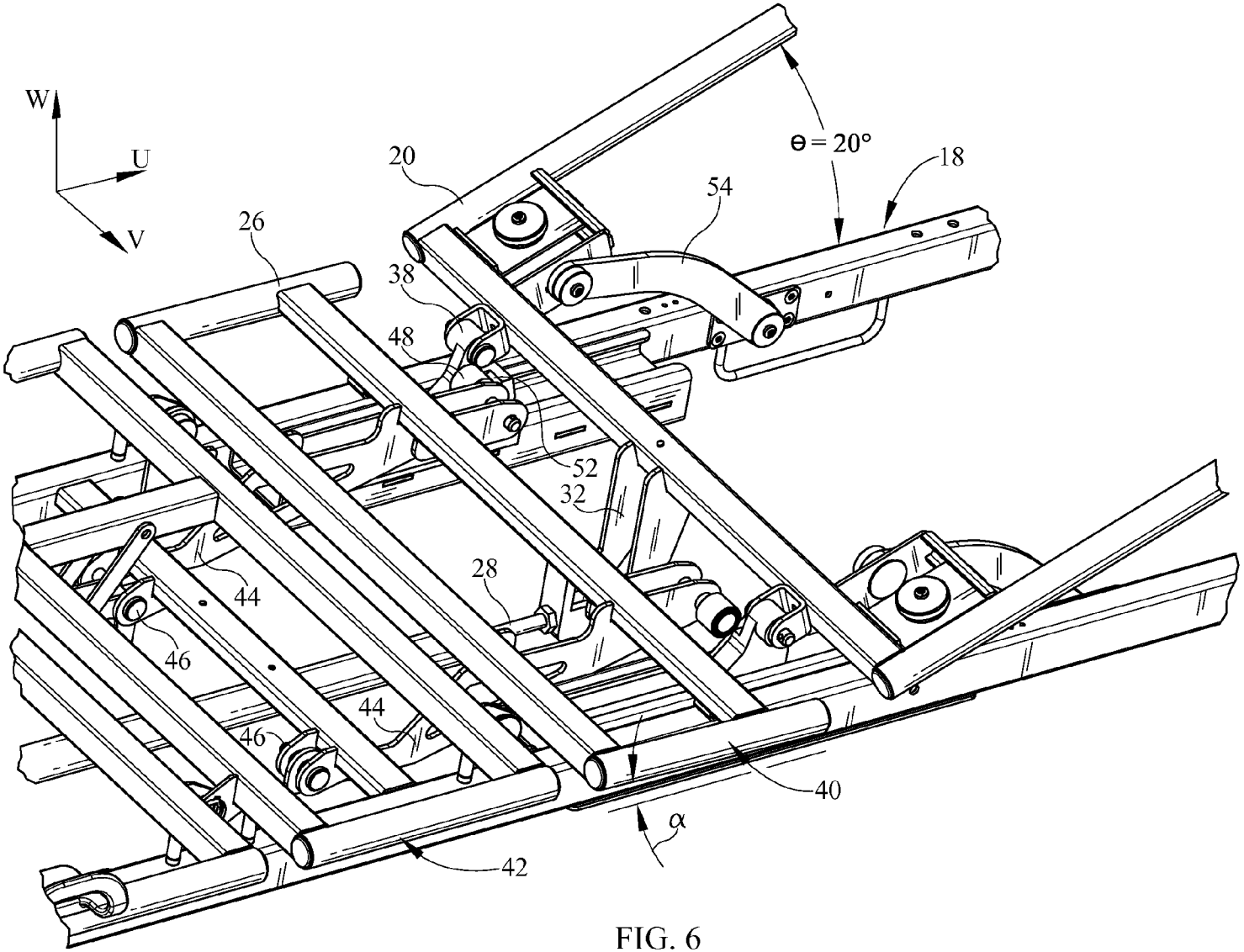
FIG. 6 is a perspective view of an articulation system for use on a person support apparatus wherein the head support deck section is at a twenty degree angle with respect to the upper frame, constructed according to one or more of the principles disclosed herein.
Figure 7:
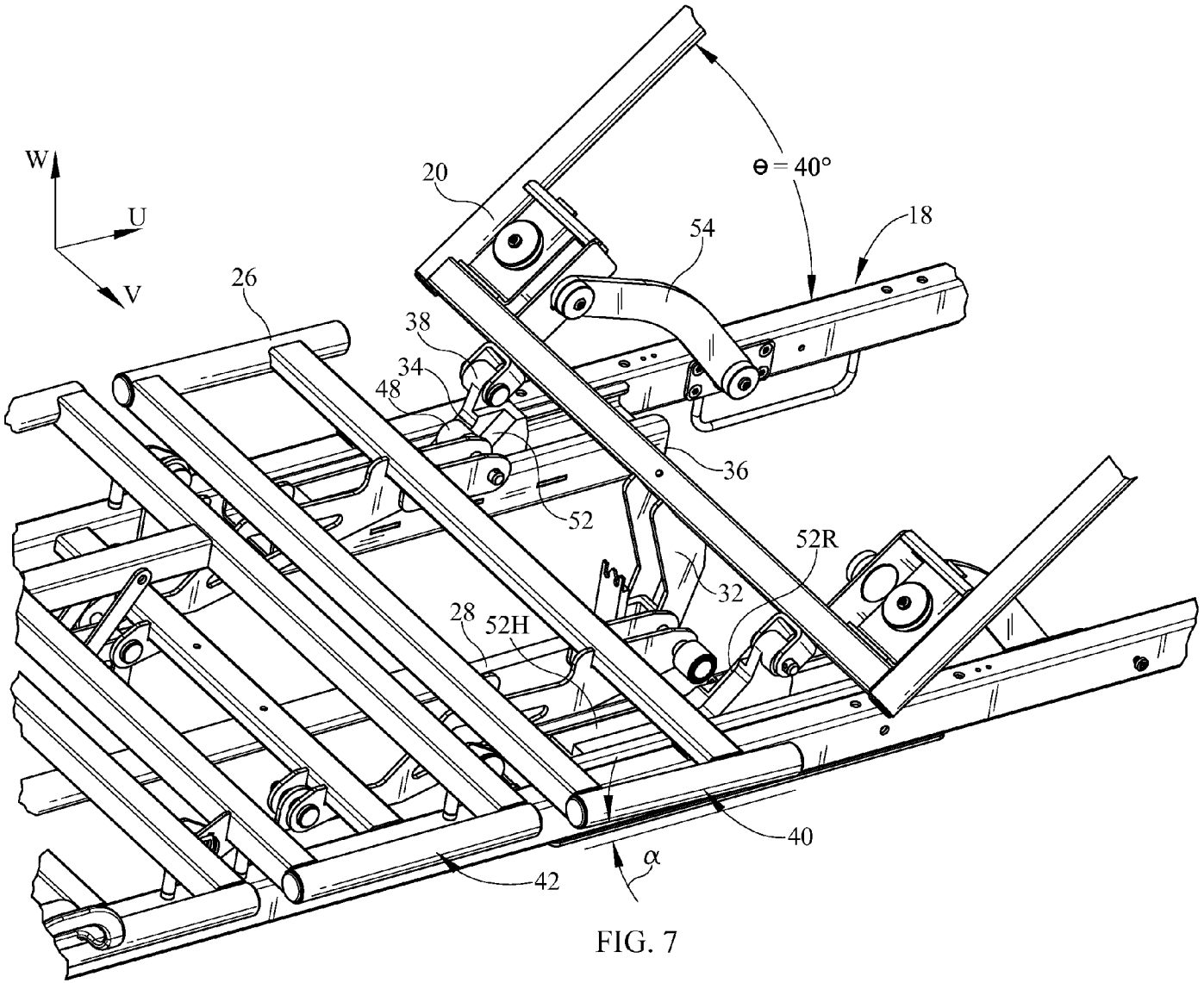
FIG. 7 is a perspective view of an articulation system for use on a person support apparatus wherein the head support deck section is at a forty degree angle with respect to the upper frame, constructed according to one or more of the principles disclosed herein.
Figure 9:
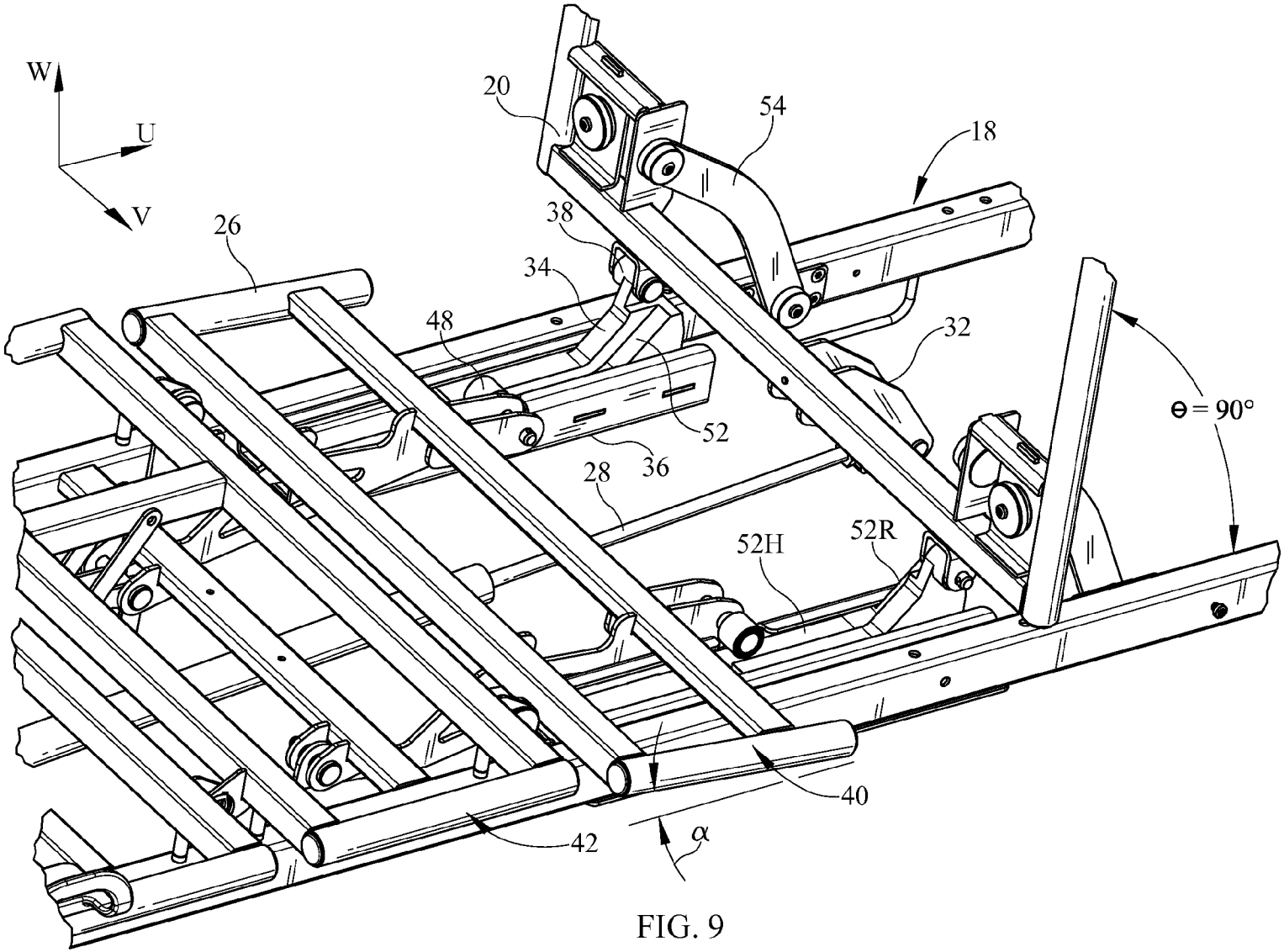
FIG. 9 is a perspective view of an articulation system for use on a person support apparatus wherein the head support deck section is at a ninety degree angle with respect to the upper frame, constructed according to one or more of the principles disclosed herein.

FIG. 3 shows a channel 36 mounted to the upper frame 18. A sliding block 34 is configured to slide within the channel 36 along the U axis and the channel 36 is configured to restrain motion of the sliding block 34 in the V-W plane. The upper body deck section 20 is pivotably connected to the sliding block 34 at the sliding block—upper frame deck section pivot 38. The upper body deck section 20 comprises an upper body deck section frame member 32. One end of gas spring 28 is pivotably connected to the upper body deck section frame member 32 while the other end of the gas spring 28 is connected to a cross member 30 of the upper frame 18. As shown in FIG. 3 the upper body deck section 20 is at an angle of inclination θ of 60 degrees with respect to the upper frame 18. The gas spring 28 is coupled to the upper body deck section frame member 32 and the cross member 30 in a manner that the gas spring 28 assists in increase of inclination of the upper body deck section 20 with respect to the upper frame 18. The increase in inclination of the upper body deck section 20 with respect to the upper frame 18 is configured to allow a person supported by the stretcher 10 to attain a seated position. As the angle of inclination of upper body deck section 20 with respect to the upper frame 18 increases, the upper body deck section 20 translates along the U axis towards the head end of the stretcher 10 as the sliding block 34 translates in the channel 36. Conversely, as the angle of inclination of upper body deck section 20 with respect to the upper frame 18 decreases, the upper body deck section 20 translates along the U axis away from the head end of the stretcher 10. The translation of the upper body deck section 20 in conjunction with variation in the angle of inclination of upper body deck section 20 with respect to the upper frame 18 aspires to accommodate anatomical motion of the hip joint of a person between a lying down position and a seated position. The upper body deck section is translatable through a range of translation from a footward limit of displacement as seen in FIG. 5 to a headward limit of displacement as seen in FIG. 9. The upper body deck section is pivotable through a range of rotation from a lower limit of inclination or orientation, such as the 0 degree orientation of FIG. 5, to an upper limit of inclination or orientation, such as the 90 degree orientation of FIG. 9. In the illustrated embodiment translational and rotational movement of the upper body deck section substantially always accompany each other. In other words any longitudinal displacement is accompanied by a change in inclination and vice versa. In other embodiments a change of inclination may accompany a translation over only part of the range of translation, or a translation may accompany a change of inclination over only part of the range of inclination.

Figure 8:
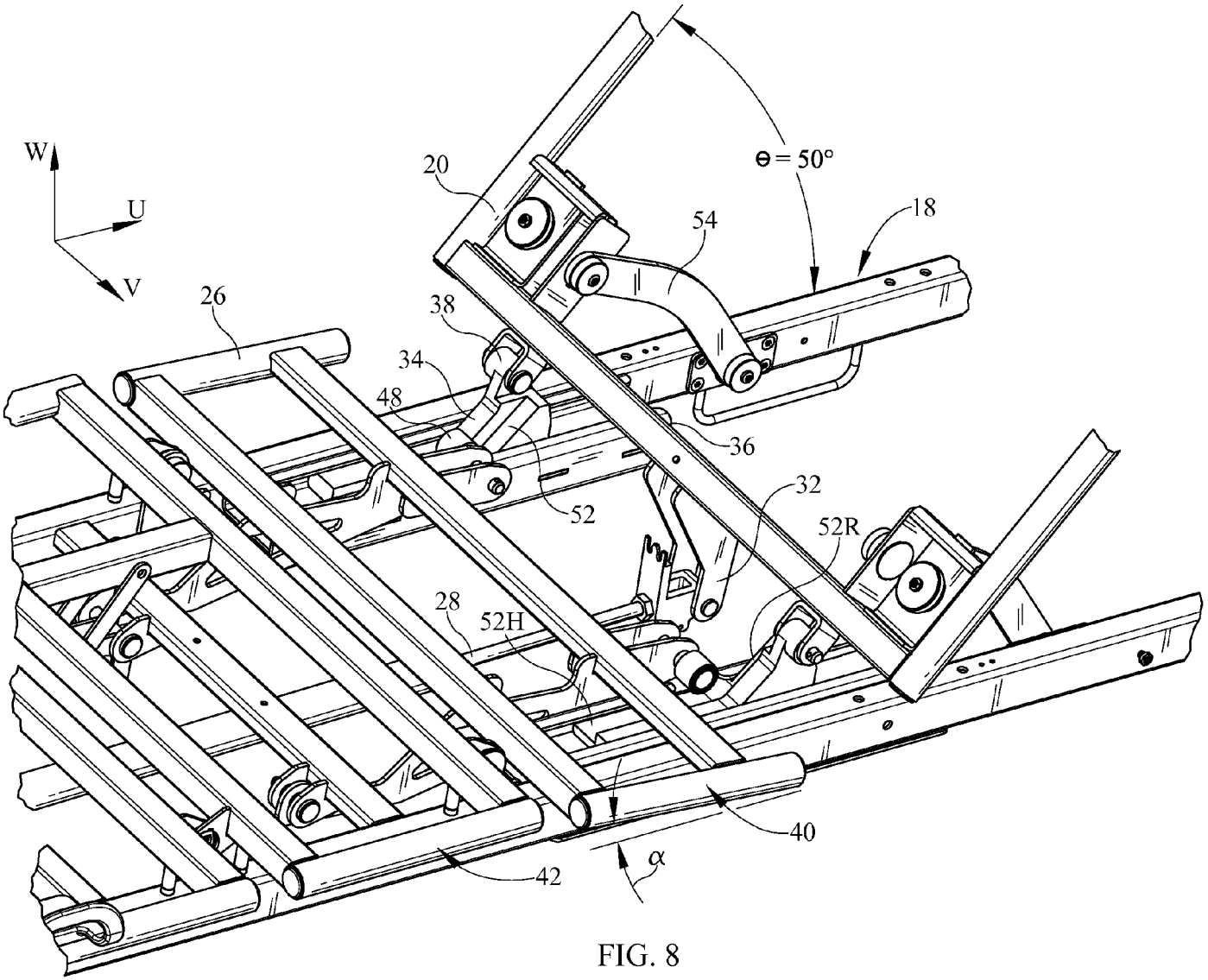
FIG. 8 is a perspective view of an articulation system for use on a person support apparatus wherein the head support deck section is at a fifty degree angle with respect to the upper frame, constructed according to one or more of the principles disclosed herein.

In FIG. 4 connections and load path of the seat deck section 26 are shown. The seat deck section 26 comprises a seat deck section support frame 44 which is welded to the seat deck section 26 in this embodiment. In other embodiments the seat deck section support frame 44 may be coupled to the seat deck section 26 using bolted, riveted, threaded or any other type of mechanical coupling. One end of the seat deck section support frame 44 is connected to a seat deck section support roller 48 by seat deck section support roller pinned connection 50. The seat deck section support roller 48 is configured to rest on a sliding block roller support track 52 of the sliding block 34 as shown in FIG. 5. The support track includes a ramped or inclined portion 52R and a horizontal portion 52H which is visible in the portion of FIG. 5 where channel 36 has been partially cut away. The other end of the seat deck section support frame 44 is connected to the upper frame 18 by the seat deck section pinned connection 46. As shown in FIG. 5 portion 52R of the sliding block roller support track 52 comprises an inclined profile such that the vertical position of the seat deck section support roller 48 in the W axis varies for at least a portion of the translation of the sliding block 34 within the channel 36 along the U axis. In this embodiment the sliding block roller support track 52 profile is such that the seat deck section support roller 48 rests on ramp portion 52R of track 52 when the upper body deck section is at an inclination or orientation of about 0 degrees through about 50 degrees (FIGS. 5-8) and rests on horizontal portion 52H of track 52 when the upper body deck section is at an inclination or orientation of about 50 degrees through about 90 degrees (FIGS. 8-9). As a result the seat deck section stops changing vertical position after the upper body deck section 20 exceeds an inclination of about 50 degrees with respect to the horizontal or the U-V plane. This can be seen by comparing FIGS. 4-9 and observing how seat angle α changes from 0 degrees in FIG. 4 to a maximum amount in FIG. 8 and remains at that maximum amount in FIG. 9. In another embodiment the sliding block roller support track may be of any profile, and need not have horizontal portion 52H.

The weight acting on the seat deck section 26 is transmitted to the sliding block roller support track 52, and therefore to the first or upper body deck section 20 by way of the seat deck section roller 48. Since a portion of the sliding block roller support track 52 comprises an inclined profile or ramp 52R, a component of the weight acting on the seat deck section 26 acts in the direction of translation of the sliding block 34 (parallel to axis U) when the roller is supported by the inclined path. However when the roller rides along the horizontal portion 52H of the support track there is no component of the weight acting in the direction of translation of the upper body section. As a result, in an embodiment in which translation and rotation of the upper body section 20 substantially always accompany each other, transmission of the weight component assists movement of the first deck section over less than all of the range of rotation and translation of the upper body deck section 20. In an embodiment in which a change of inclination accompanies a translation over only part of the range of translation, transmission of the weight component assists movement of the first deck section over less than all of the range of translation of the upper body deck section 20. In an embodiment in which a translation accompanies a change of inclination over only part of the range of inclination, transmission of the weight component assists movement of the first deck section over less than all of the range of inclination of the upper body deck section 20. The component of weight acting on the seat deck section 26 along axis U assists in translation of the sliding block 34 towards the head end and therefore assists in increasing the inclination of the upper body deck section 20 with respect to the upper frame 18. Typically, a portion of the weight of the patient supported by the person support apparatus 10 acts on the seat deck 26. Therefore the teachings herein allow the use of a portion of the weight supported by the seat deck section 26 to assist in increasing the inclination of the upper body deck section 20 with respect to the upper frame 18. A portion of the weight of a patient supported by the stretcher 10 is used to provide assistance to a caregiver for increasing inclination of the upper body section 20 with respect to the upper frame 18. As already noted, first or upper body deck section 20 is also translatably and pivotably movable with respect to the frame such that as the angle of inclination of the first deck section relative to the frame decreases, the first deck section translates away from the head end of the person support apparatus. As a result, the component of weight which acts on the second deck section and which is transmitted to the first deck section resists the translational and rotational movement of the first deck section, thus facilitating a gradual rather than abrupt decrease in the angular orientation θ.

FIG. 6, FIG. 7, FIG. 8 and FIG. 9 depict the inclination of the upper body deck section 20 with respect to the upper frame 18 and therefore the U-V plane by 20, 40, 50 and 90 degrees respectively. As the upper body deck section 20 varies inclination with respect to the upper frame 18 an upper body deck section link 54 transmits a portion of the load acting on the upper body deck section 20 to the upper frame 18. The upper body deck section link 54 is connected to the upper frame 18 and the upper body deck section 20 by pinned connections. As the upper body deck section 20 increases inclination, the sliding block 34 translates towards the head end of the stretcher, and the seat deck section support roller 48 vertically drops as it follows the profile of the sliding block roller support track 52. As the seat deck section support roller 48 drops vertically, the inclination of the seat deck section 26 increases with respect to the upper frame 18 or the U-V plane.

As will be appreciated from the foregoing the second deck section (seat section) undergoes a change of angular orientation α with respect to the frame member in conjunction with the second deck section assisting movement of the first deck section. The change of orientation of the second deck section is in a rotational sense opposite to that of the change of inclination of the first or upper body deck section.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

Preferred embodiments are described herein, including the best mode known to the inventor for carrying out the claimed subject matter. Of course, variations of those preferred embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

The disclosures of any references and publications cited above are expressly incorporated by reference in their entireties to the same extent as if each were incorporated by reference individually.

I claim:

1. An articulation system for use on a person support apparatus comprising:

a frame;

a first deck section supported on the frame, the first deck section being translatably and pivotably movable with respect to the frame such that as the angle of inclination of the first deck section relative to the frame increases, the first deck section translates toward a head end of the person support apparatus; and a second deck section configured to support a portion of a person thereon, and wherein at least a component of weight acting on the second deck section is transmitted to the first deck section thereby assisting the movement of the first deck section.

2. The system of claim 1 wherein the first deck section is translatable through a range of translation and is pivotable through a range of rotation and wherein the translational and rotational movement of the first deck section substantially always accompany each other.

3. The system of claim 2 wherein transmission of the weight component assists movement of the first deck section over less than all of the range of rotation and translation.

4. The system of claim 1 wherein the first deck section is translatable through a range of translation and is pivotable through a range of rotation and wherein transmission of the weight component assists movement of the first deck section over less than all of the range of rotation.

5. The system of claim 1 wherein the first deck section is translatable through a range of translation and is pivotable through a range of rotation and wherein transmission of the weight component assists movement of the first deck section over less than all of the range of translation.

6. The system of claim 1 wherein the first deck section is also translatably and pivotably movable with respect to the frame such that as the angle of inclination of the first deck section relative to the frame decreases, the first deck section translates away from the head end of the person support apparatus, and wherein the component of weight acting on the second deck section is transmitted to the first deck section thereby resisting the movement of the first deck section.

7. The system of claim 1 wherein the second deck section undergoes a change of angular orientation with respect to the frame member in conjunction with the second deck section assisting movement of the first deck section.

8. The system of claim 7 wherein the change of orientation of the second deck section is in a rotational sense opposite to that of the change of inclination of the first deck section.

9. The system of claim 1 wherein the first section is an upper body section and the second section is a seat section.

10. The system of claim 1 wherein:

the first deck section includes a sliding block having a profiled support track, the block being constrained to slide relative to the frame in a lengthwise direction of the frame as the first deck section translates; and the second deck section includes a roller in contact with the support track.

11. The system of claim 10 wherein the frame includes a channel and the sliding block is constrained to slide in the channel.

12. The system of claim 1 comprising a gas spring having a first end pivotably connected to the frame and a second end connected to the first deck section.

13. The system of claim 3 wherein said gas spring is configured to assist in motion of said first deck section to increase said angular inclination of said first deck section with respect to said frame member.

14. An articulation system for use on a person support apparatus comprising:

a frame;

a first deck section supported on the frame, the first deck section being translatably and pivotably movable with respect to the frame such that the angle of inclination of the first deck section relative to the frame increases, the first deck section translates toward a head end of the person support apparatus; and;

a second deck section configured to support a portion of a person thereon, said second deck section being responsive to the movement of the first deck section such that the second deck section undergoes a change in angular orientation with respect to said frame member as said first deck section moves.

15. The system of claim 14 wherein the first deck section includes a sliding block configured to translate in a channel of the frame, the sliding block having a track which includes a ramp portion, the second deck section including a roller in contact with the track and wherein rotation of the first deck section causes the roller to ride along the ramp portion thereby causing a first end of the second deck section to change elevation relative to a second end of the second deck section thereby effecting the change orientation of the second deck section.

16. The system of claim 14 further comprising a gas spring wherein a first end of said gas spring is pivotably connected to the frame and a second end of the gas spring is connected to the first deck section.

17. The system of claim 16 wherein the gas spring is configured to assist in motion of the first deck section to change the angular inclination of the first deck section with respect to the frame.

* * * * *